US010323412B2

(12) United States Patent
Koziol

(10) Patent No.: US 10,323,412 B2
(45) Date of Patent: Jun. 18, 2019

(54) WALL-MOUNT SYSTEM FOR HANGING MODULES

(71) Applicant: BENTO BOX LLC, Brooklyn, NY (US)

(72) Inventor: Justin Koziol, Brooklyn, NY (US)

(73) Assignee: BENTO BOX LLC, Brooklyn, NY (US)

( * ) Notice: Subject to any disclaimer, the term of this patent is extended or adjusted under 35 U.S.C. 154(b) by 66 days.

(21) Appl. No.: 15/722,532

(22) Filed: Oct. 2, 2017

(65) Prior Publication Data

US 2018/0094431 A1 Apr. 5, 2018

Related U.S. Application Data

(60) Provisional application No. 62/403,294, filed on Oct. 3, 2016.

(51) Int. Cl.
*E04B 2/74* (2006.01)
*E04F 13/08* (2006.01)
(Continued)

(52) U.S. Cl.
CPC ..... *E04B 2/7453* (2013.01); *E04F 13/081* (2013.01); *A47B 47/0091* (2013.01);
(Continued)

(58) Field of Classification Search
CPC ... E04F 13/081–13/0814; E04F 13/083; E04F 13/24; E04B 2/7453;
(Continued)

(56) References Cited

U.S. PATENT DOCUMENTS 4,826,115 A * 5/1989 Novitski ..... A47B 57/42 248/224.8
5,063,715 A * 11/1991 Goodman ..... A47B 57/16 211/192

(Continued)

FOREIGN PATENT DOCUMENTS

GB 2414029 A * 11/2005 ..... E04F 13/0812

OTHER PUBLICATIONS

Notification of Transmittal of the International Search Report and The Written Opinion of the International Searching Authority, or the Declaration issued in corresponding PCT application No. PCT/US2017/054744 dated Dec. 15, 2017.

*Primary Examiner* — Babajide A Demuren
(74) *Attorney, Agent, or Firm* — Carter, DeLuca & Farrell, LLP

(57) ABSTRACT

A wall-mount system includes a frame assembly having horizontal ledgers configured for attachment to a wall and first and second vertical struts releasably engagable with the horizontal ledgers and each including a mounting surface defining a receiver slot. A module is releasably mountable on the frame assembly and includes first and second cleats disposed towards opposite sides of the module. The cleats are configured to releasably engage the vertical struts and each includes a base and an upright extending from each side of the base to define a U-shaped configuration. The base includes a spring finger extending therefrom between the uprights. Each upright includes a hook. The hooks are configured for receipt with the receiver slots to engage the module with the frame assembly. The spring fingers are biased into contact with the mounting surfaces of the vertical struts to maintain the engagement of the module with the frame assembly.

19 Claims, 12 Drawing Sheets

(51) Int. Cl.
*A47B 47/00* (2006.01)
*A47B 95/00* (2006.01)
*E04F 13/24* (2006.01)

(52) U.S. Cl.
CPC ..... *A47B 95/008* (2013.01); *E04B 2002/7462* (2013.01); *E04B 2002/7466* (2013.01); *E04F 13/083* (2013.01); *E04F 13/24* (2013.01)

(58) Field of Classification Search
CPC ..... E04B 2002/7466; E04B 2002/7462; A47B 95/008; A47B 47/0091
See application file for complete search history.

(56) References Cited

U.S. PATENT DOCUMENTS 5,069,408 A 12/1991 Bessinger
5,348,385 A 9/1994 Berg
5,791,093 A 8/1998 Diamond
6,109,461 A 8/2000 Kluge et al.
6,230,907 B1 5/2001 Stuart
6,711,871 B2 3/2004 Beirise et al.
7,228,977 B2 6/2007 Perkins et al.
8,037,642 B2 10/2011 Nagel et al.
8,104,850 B2 1/2012 Hager et al.
10,104,959 B2 * 10/2018 Nilsson ..... A47F 5/103
2005/0247654 A1 11/2005 Walker
2007/0221595 A1 9/2007 Chen
2007/0235614 A1 * 10/2007 O'Keene ..... F16M 13/02 248/309.1
2008/0067139 A1 * 3/2008 Claypool ..... A47B 47/022 211/205
2010/0090567 A1 4/2010 Felice
2010/0116762 A1 5/2010 Piersant et al.
2010/0309615 A1 12/2010 Grey et al.
2012/0117910 A1 5/2012 Chuang
2012/0255919 A1 * 10/2012 Jones ..... F16M 11/10 211/26
2013/0062300 A1 * 3/2013 Drake ..... A47B 57/34 211/183
2013/0126454 A1 5/2013 Zang et al.
2013/0183088 A1 7/2013 Wilkinson, Jr. et al.
2013/0299649 A1 * 11/2013 Lam ..... F16M 11/10 248/200
2013/0313390 A1 * 11/2013 Huang ..... F16M 11/041 248/226.11
2014/0138332 A1 5/2014 Loree et al.
2014/0284442 A1 * 9/2014 Molter ..... F16M 11/10 248/288.11
2016/0312948 A1 * 10/2016 Stifal ..... F16M 11/10
2017/0059087 A1 * 3/2017 Lam ..... F16M 11/046

* cited by examiner

WALL-MOUNT SYSTEM FOR HANGING MODULES

CROSS REFERENCE TO RELATED APPLICATION

This application claims the benefit of and priority to U.S. Provisional Application Ser. No. 62/403,294, filed on Oct. 3, 2016, the entire contents of which are incorporated herein by reference.

BACKGROUND

The present disclosure relates to wall-mount systems and, more specifically, to a wall-mount system for hanging modules.

Modular wall-mount systems are generally known. However, because of the increasing premium on square-footage, there is a continuing need for visually appealing, space-saving, and easy-to-install wall-mount system for hanging modules.

SUMMARY

To the extent consistent, any of the aspects and features detailed herein may be utilized with any of the other aspects and features detailed herein.

Provided in accordance with aspects of the present disclosure is a wall-mount system including a frame assembly and a module. The frame assembly includes a plurality of horizontal ledgers configured for attachment to a wall and first and second vertical struts releasably engagable with the plurality of horizontal ledgers. Each of the first and second vertical struts includes a mounting surface defining a first receiver slot. The module is releasably mountable on the frame assembly and includes first and second cleats disposed towards opposite sides of the module. The first and second cleats are configured to releasably engage the first and second vertical struts, respectively. Each of the first and second cleats includes a base and an upright extending from each side of the base to define a U-shaped configuration. The base includes a first spring finger extending therefrom between the uprights. Each upright includes a first hook disposed towards a first end thereof. The first hooks of the first and second cleats are configured for receipt with the first receiver slots of the first and second vertical struts, respectively, to engage the module with the frame assembly. The first spring fingers of the first and second cleats are biased into contact with the mounting surfaces of the first and second vertical struts, respectively, to maintain the engagement of the module with the frame assembly.

In an aspect of the present disclosure, the first spring fingers are cut-out from the bases of the first and second cleats and deflected therefrom between the uprights.

In another aspect of the present disclosure, each of the first and second cleats is formed from a single piece of steel.

In another aspect of the present disclosure, the uprights of the first and second cleats include second hooks disposed towards respective second ends thereof. The second hooks are configured for receipt within second receiver slots of the first and second vertical struts, respectively.

In still another aspect of the present disclosure, the bases of the first and second cleats include second spring fingers extending therefrom between the uprights. The second spring fingers of the first and second cleats are biased into contact with the mounting surfaces of the first and second vertical struts, respectively. In such aspects, the first spring fingers may be disposed towards the first ends of the uprights and the second spring fingers may be disposed towards the second ends of the uprights.

In yet another aspect of the present disclosure, the module further includes a latch mechanism having first and second spring posts movable from an inwardly retracted position to an outwardly extended position. In such aspects, each of the first and second vertical struts defines a transverse aperture configured to receive one of the first or second spring posts in the outwardly extended position thereof to releasably lock the module in engagement with the frame assembly.

In still yet another aspect of the present disclosure, the latch mechanism includes a lever configured for selective manipulation to transition the first and second spring posts between the inwardly retracted position and the outwardly extended position. The first and second spring posts may be biased towards the inwardly retracted position.

In another aspect of the present disclosure, the latch mechanism extends transversely between the first and second cleats towards second ends of the uprights of the first and second cleats.

In another aspect of the present disclosure, the uprights of the first and second cleats include nubs towards the second ends thereof. The nubs are configured for receipt within second receiver slots of the first and second vertical struts, respectively, to align the module for receipt of the first and second spring posts within the transverse apertures of the first and second vertical struts.

In yet another aspect of the present disclosure, each of the plurality of horizontal ledgers includes a pair of base flanges configured to abut a wall surface and a mounting surface raised relative to the pair of base flanges.

In still another aspect of the present disclosure, the mounting surface of each of the plurality of horizontal ledgers defines a plurality of mounting arrangements along a length thereof.

In another aspect of the present disclosure, each of the plurality of horizontal ledgers is formed from a single piece of steel.

In still yet another aspect of the present disclosure, the first vertical strut is a single vertical strut and/or the second vertical strut is a double vertical strut.

In another aspect of the present disclosure, each of the first and second vertical struts is formed from a single piece of steel.

In another aspect of the present disclosure, each of the first and second vertical struts defines a C-shaped configuration including feet extending from side legs thereof. The feet are configured for receipt within slots defined within the plurality of horizontal ledgers to releasably mount the first and second vertical struts on the plurality of horizontal ledgers.

In still another aspect of the present disclosure, the first and second vertical struts and the plurality of horizontal ledgers each further include apertures configured to enable bolting of the first and second vertical struts to the plurality of horizontal ledgers.

In yet another aspect of the present disclosure, the module includes a panel having the first and second cleats mounted on a backside thereof.

BRIEF DESCRIPTION OF THE DRAWINGS

Aspects and features of the present disclosure are described hereinbelow with reference to the drawings, wherein.

DETAILED DESCRIPTION OF THE EMBODIMENTS

Detailed embodiments of the present disclosure are disclosed herein; however, the disclosed embodiments are merely examples of the disclosure, which may be embodied in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure.

Figure 6:
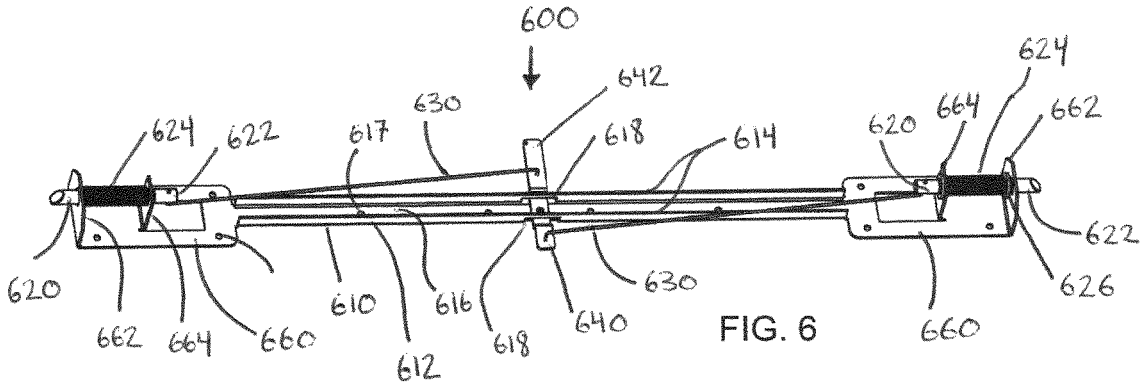
FIG. 6 is a side, perspective view of a latch mechanism configured for use with the panels of FIGS. 4 and 5 and having the cover removed therefrom.
Figure 7:
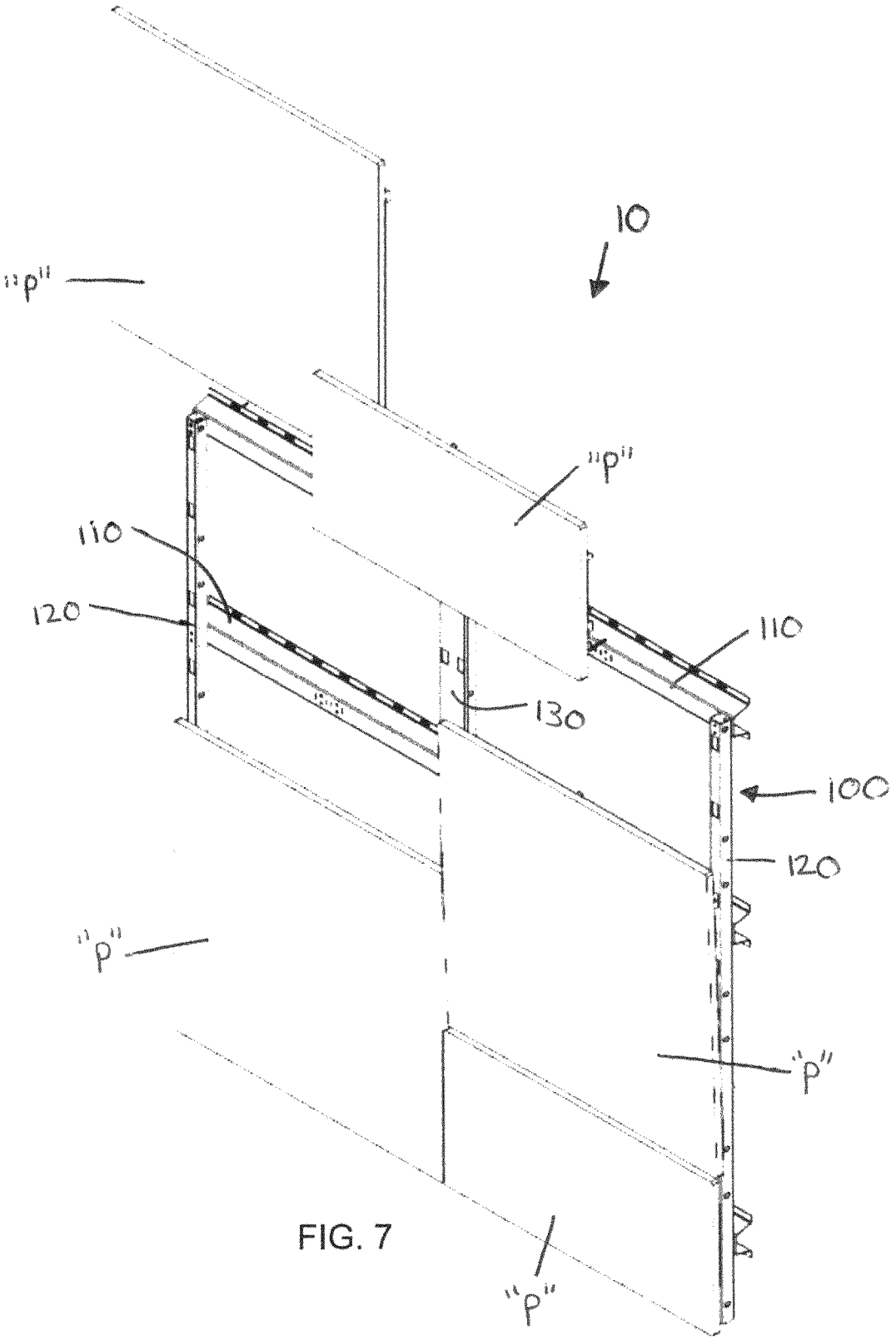
FIG. 7 is a front, perspective view of the wall-mount system provided in accordance with of the present disclosure illustrating engagement of panels with the frame assembly.
Figure 8:
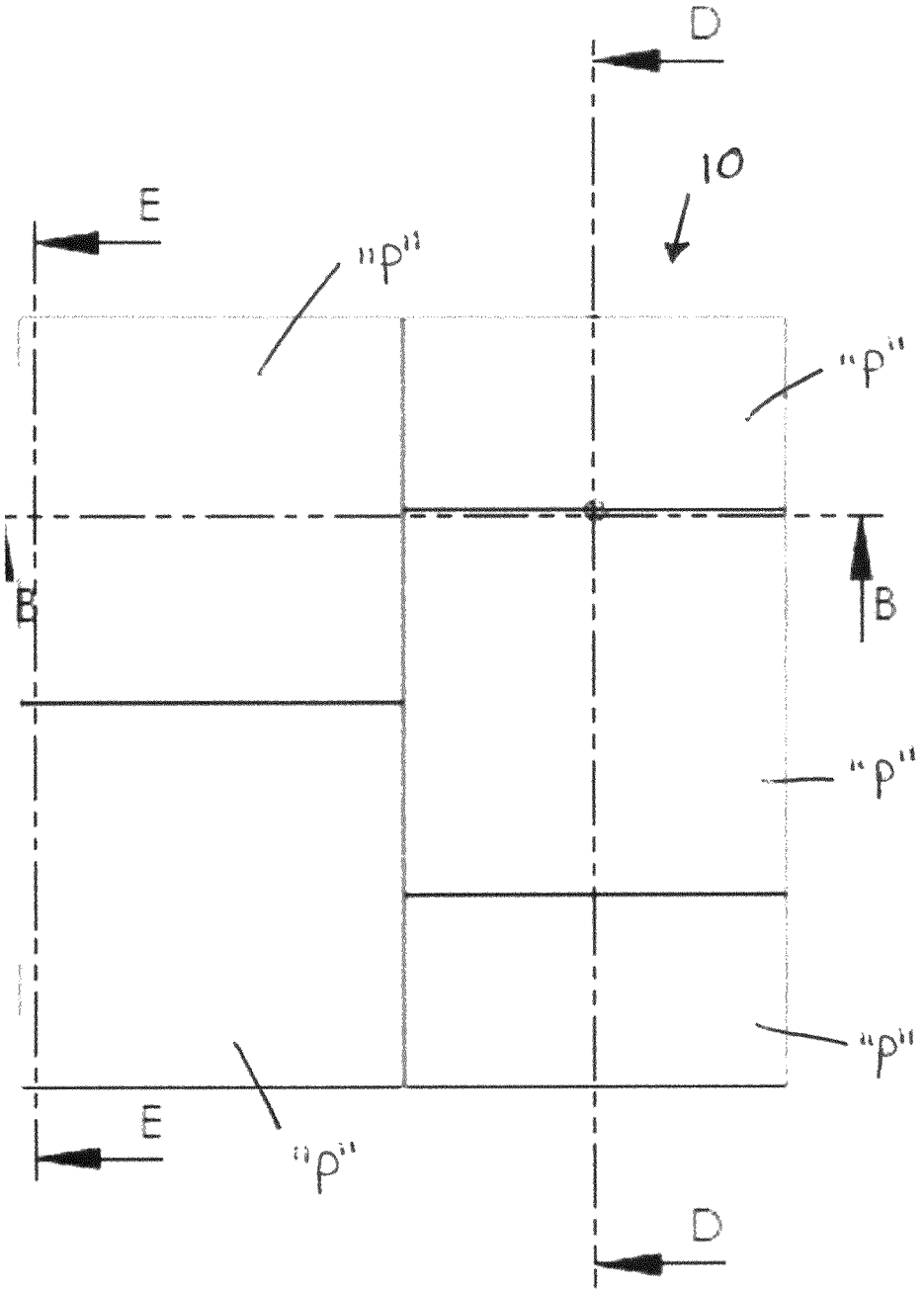
FIG. 8 is a front view of the wall-mount system of the present disclosure.
Figure 9:
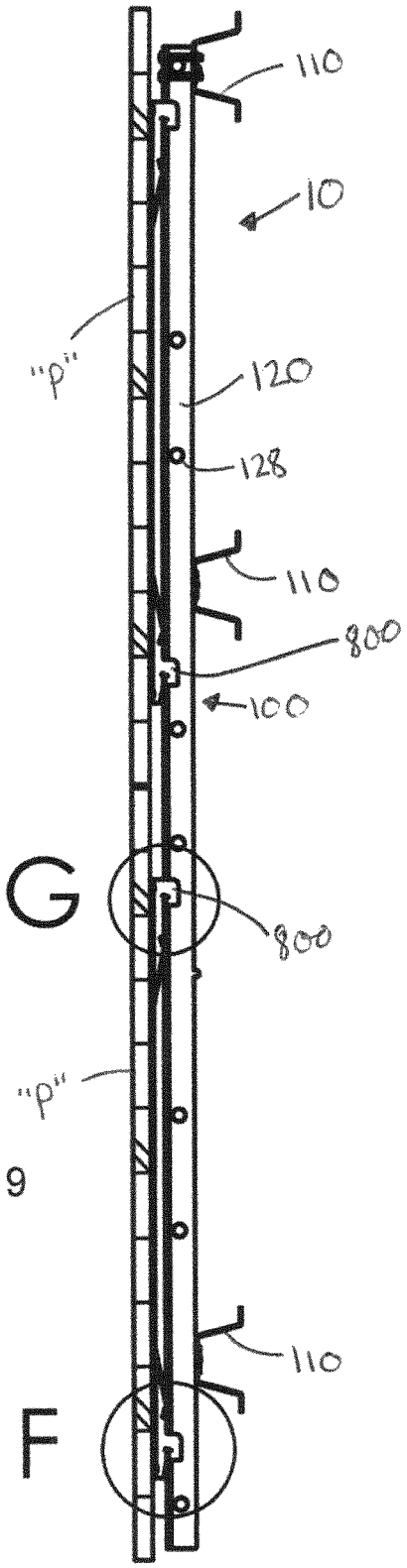
FIG. 9 is a cross-sectional view taken along section line "E-E" in FIG. 8.
Figure 10:
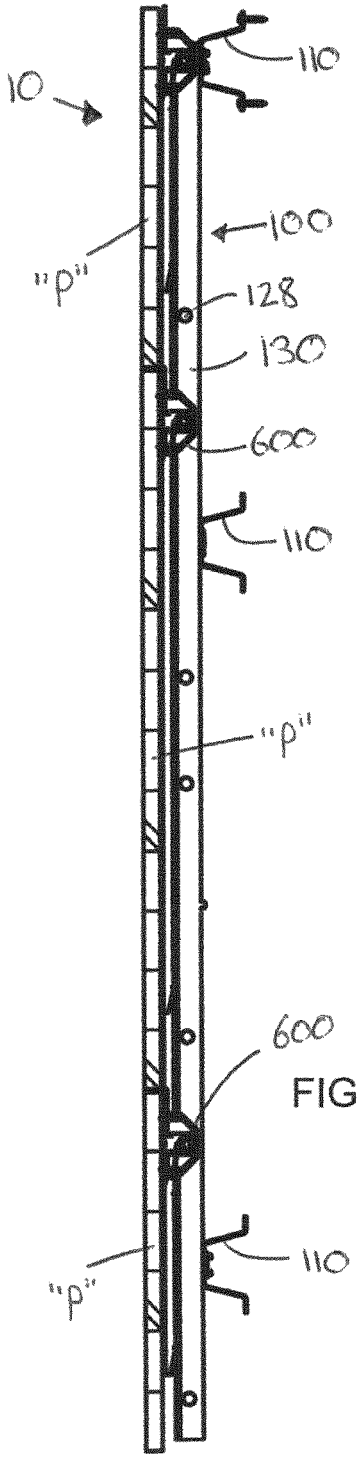
FIG. 10 is a cross-sectional view taken along section line "D-D" in FIG. 8.
Figure 11:
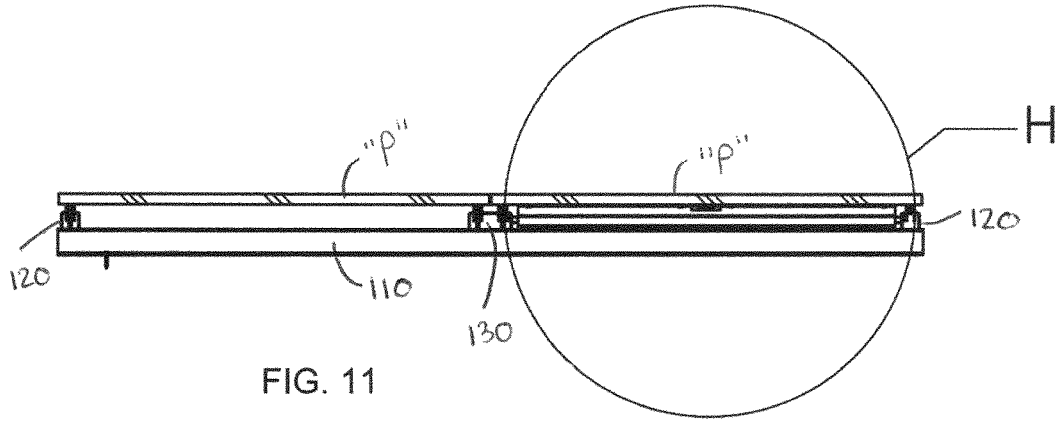
FIG. 11 is a cross-sectional view taken along section line "B-B" in FIG. 8.
Figure 12:
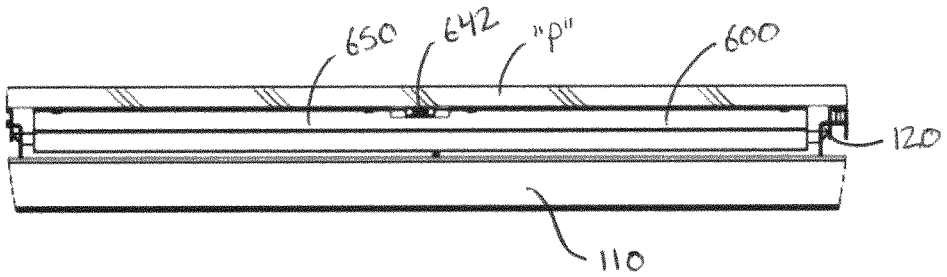
FIG. 12 is an enlarged view of the area of detail indicated as "H" in FIG. 11.
Figure 13:
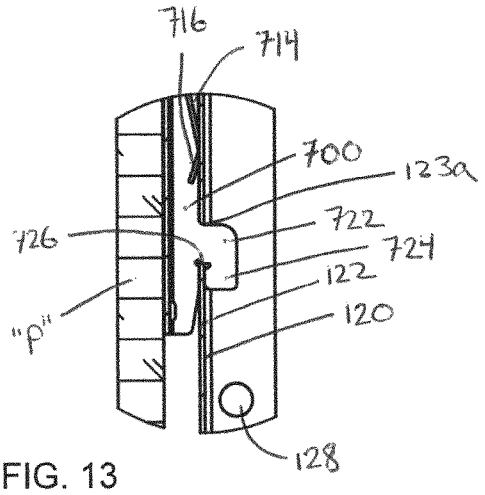
FIG. 13 is an enlarged view of the area of detail indicated as "F" in FIG. 9.
Figure 14:
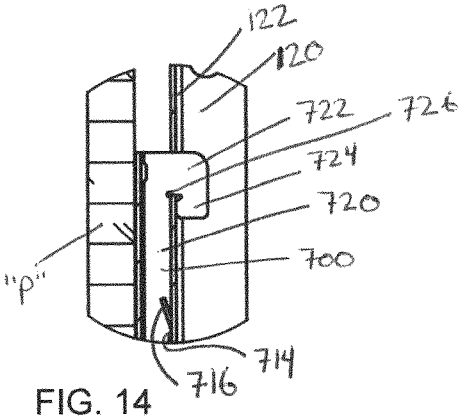
FIG. 14 is an enlarged view of the area of detail indicated as "G" in FIG. 9.

Referring generally to FIGS. 1-20, provided in accordance with the present disclosure is a wall-mount system 10 (FIG. 7). Wall-mount storage system 10 (FIG. 7) includes a frame assembly 100 and a plurality of modules, e.g., panels "P" and/or panels 200-500, releasably mountable on frame assembly 100 in any suitable arrangement. Although panels "P" are illustrated as modules configured for use with system 10, it is contemplated that the modules may include any suitable structures including and/or mounting components thereon such as, for example, fixed shelves, pivoting shelves, single or double-door cabinets, drawers, Murphy beds, cubby boxes, hooks, pegs, and the like.

Figure 1:
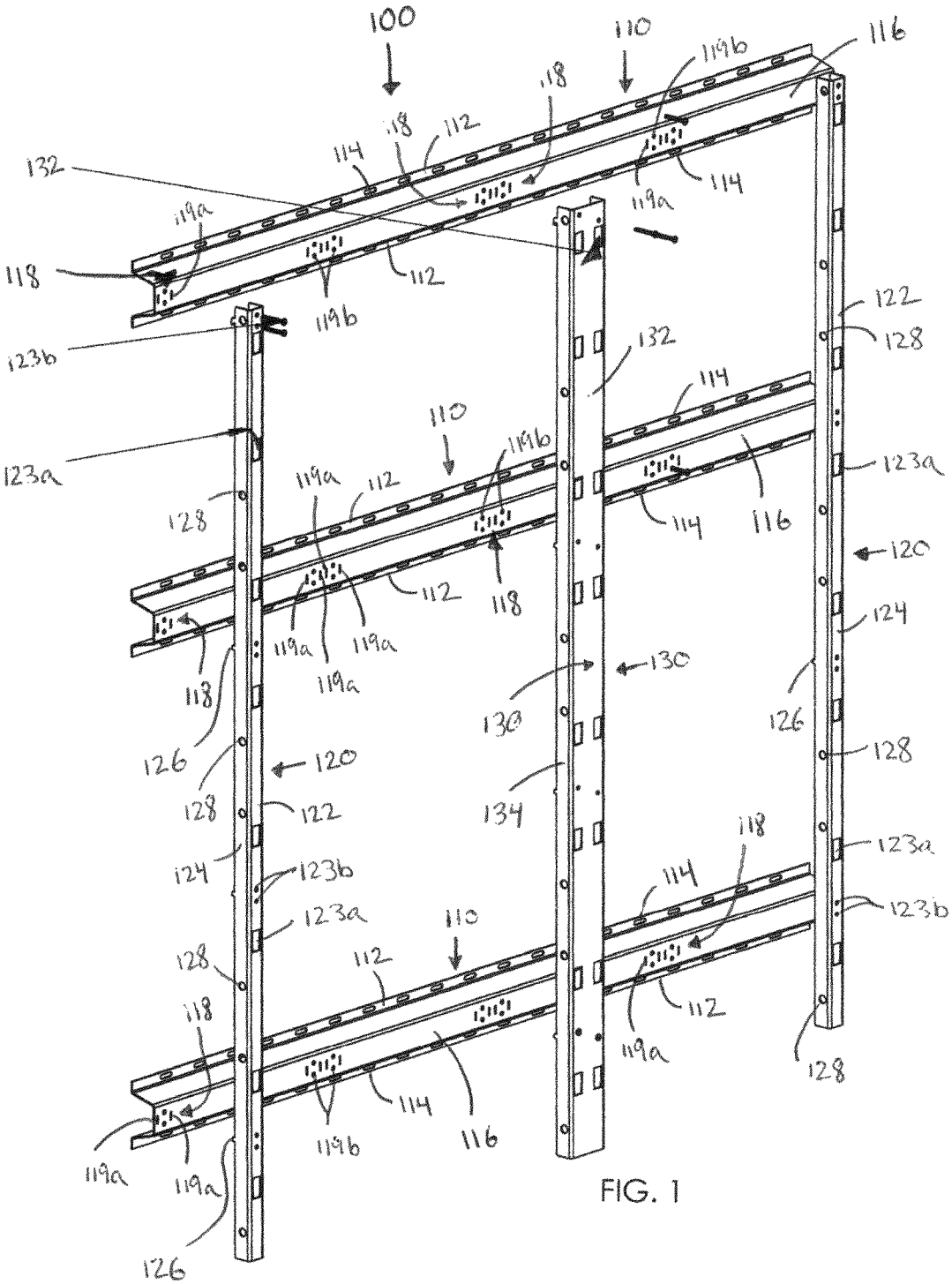
FIG. 1 is a front, perspective, exploded view of a frame assembly of a wall-mount system provided in accordance with the present disclosure.

Referring to FIG. 1, frame assembly 100 includes a plurality of horizontal ledgers 110 and a plurality of vertical struts 120, 130. Horizontal ledgers 110 and vertical struts 120, 130 may each be formed from a single piece of cold rolled steel. Horizontal ledgers 110 are similar to one another and, thus, are described below in the singular with reference to one horizontal ledger 110.

Horizontal ledger 110 defines a generally C-shaped configuration and is configured for mounting horizontally on a wall (not shown). Horizontal ledger 110 includes a pair of base flanges 112 configured to abut the wall and defines a plurality of spaced-apart slots 114 along the length thereof to enable mounting of horizontal ledger 110 to studs (not shown) supporting the wall, e.g., using suitable screws or other hardware (not shown).

Horizontal ledger 110 further includes a mounting surface 116 raised relative to base flanges 112 (and the wall) due to the C-shaped configuration of horizontal ledger 110. Mounting surface 116 defines a plurality of spaced-apart mounting arrangements 118 therethrough. One or more mounting arrangements 118 may be spaced-apart from one or more other mounting arrangements 118 and/or one or more mounting arrangements 118 may be disposed adjacent one or more other mounting arrangements 118. For example, each end of horizontal ledger 110 may include a single mounting arrangement 118 while a plurality of adjacent-pairs of mounting arrangements 118 are spaced-apart along horizontal ledger 110 between the ends thereof. Mounting arrangements 118 may define any suitable configuration such as, for example, a pair of spaced-apart vertical slots 119*a* having a vertically-aligned pair of apertures 119*b* disposed therebetween.

Vertical struts 120, 130 include single vertical struts 120 and double vertical struts 130, each defining a C-shaped configuration and configured for mounting to two or more of the horizontal ledgers 110. Alternatively or additionally, vertical struts 120, 130 may be mounted to a U-channel secured to a floor or ceiling (not shown). Single vertical struts 120 are similar to one another and, thus, are described below in the singular with reference to one vertical strut 120. Likewise, double vertical struts 130 are similar to one another and, thus, are described below in the singular with reference to one double vertical strut 130.

Single vertical strut 120 includes features suitable for engaging a single mounting arrangement 118 of each of two or more horizontal ledgers 110, while double vertical strut 130 includes features suitable for engaging an adjacent pair of mounting arrangements 118 of each of two or more horizontal ledgers 110.

Single vertical strut 120 includes a mounting surface 122 and a pair of side legs 124 depending from either side of the mounting surface 122. Each side leg 124 includes a plurality of spaced-apart feet 126 extending therefrom along the length thereof. Each foot 126 is aligned with a foot 126 foot on the other side leg 124 such that feet 126 are provided in horizontally-aligned pairs. Side legs 124 are spaced-apart a distance equal to the spacing between the vertical slots 119*a* of one of the mounting arrangements 118 of horizontal ledger 110 such that an aligned pair of feet 126 may be inserted through the aligned vertical slots 119*a* of one of the mounting arrangements 118. Each foot 126 may further defines a toe (not explicitly shown) such that, upon insertion of feet 126 into vertical slots 119*a* and downward translation of vertical strut 120 relative to horizontal ledger 110, the toes catch on horizontal ledger 110 to engage vertical strut 120 with horizontal ledger 110. Side legs 124 further define aligned pairs of transverse apertures 128 therethrough and disposed in spaced-apart relation along the length thereof, as detailed below.

Mounting surface 122 of vertical strut 120 defines a plurality of spaced-apart receiver slots 123*a* along the length thereof and one or more apertures 123*b* disposed along the length thereof. The one or more apertures 123*b* are configured for alignment with one or more of the vertically-aligned pair of apertures 119*b* of one of the mounting arrangements 118 of horizontal ledger 110 when vertical strut 120 is engaged thereon to enable bolting of vertical strut 120 to horizontal ledger 110 to securely lock vertical strut 120 in engagement with horizontal ledger 110. Receiver slots 123*a* are detailed below.

Vertical strut 130 includes a mounting surface 132 and a pair of side legs 134 depending from either side of the mounting surface 132 and is similar to vertical strut 120 except that mounting surface 132 generally takes the form of a pair of abutting mounting surfaces 122 formed together. As such, side legs 134 are spaced-apart a distance equal to the spacing between the outer-most vertical slots 119*a* of an adjacent pair of mounting arrangements 118 of horizontal ledger 110.

Turning now to FIGS. 2-6, various panels 200-500 are configured for releasable mounting on frame assembly 100. Panels 200, 300 are similar to one another in the manner in which they are engaged with frame assembly 100 but differ in terms of dimensions. Likewise, panels 400, 500 are similar to one another in the manner in which they are engaged with frame assembly 100 but differ in terms of dimensions.

Figure 2:
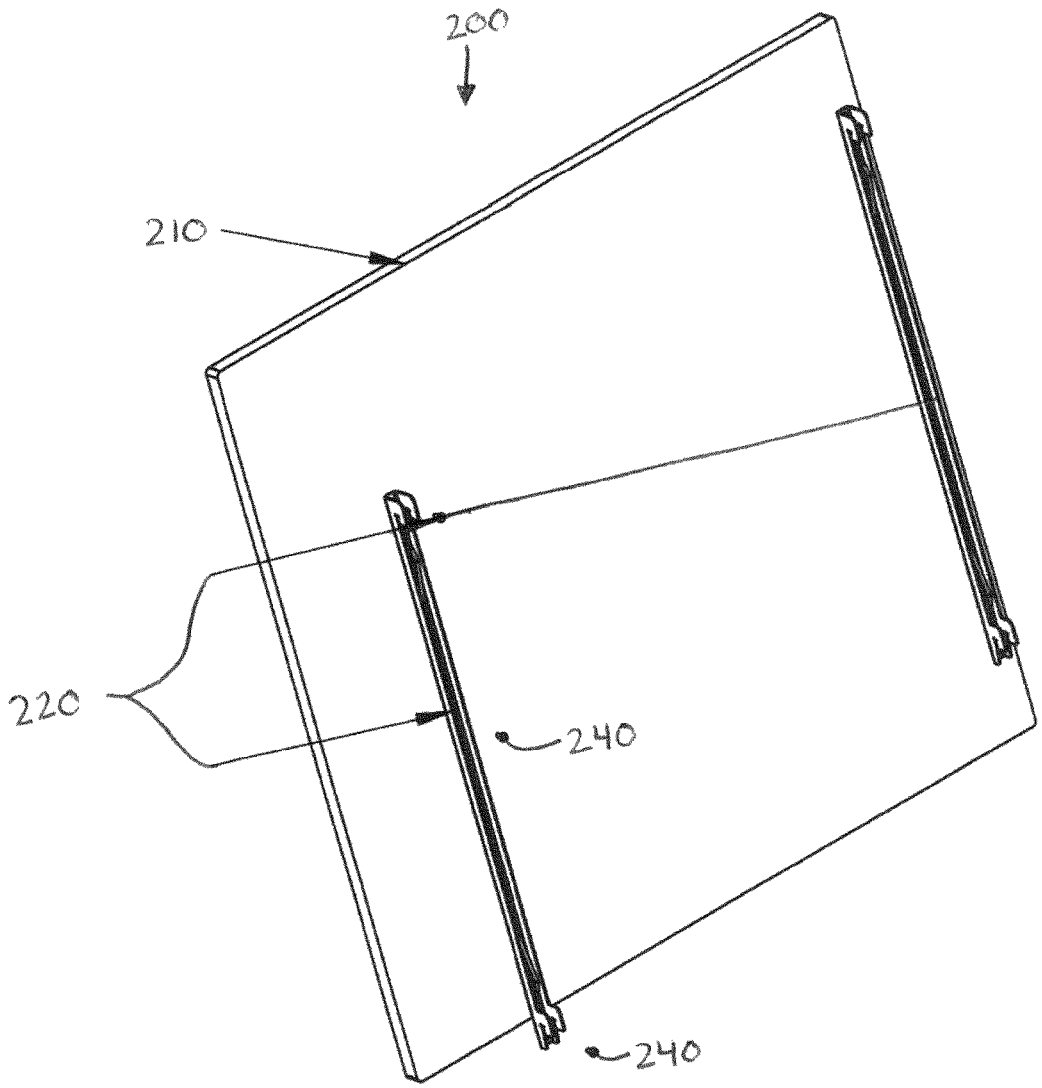
FIG. 2 is a rear, perspective view of a panel configured for releasable mounting on the frame assembly of FIG. 1.
Figure 3:
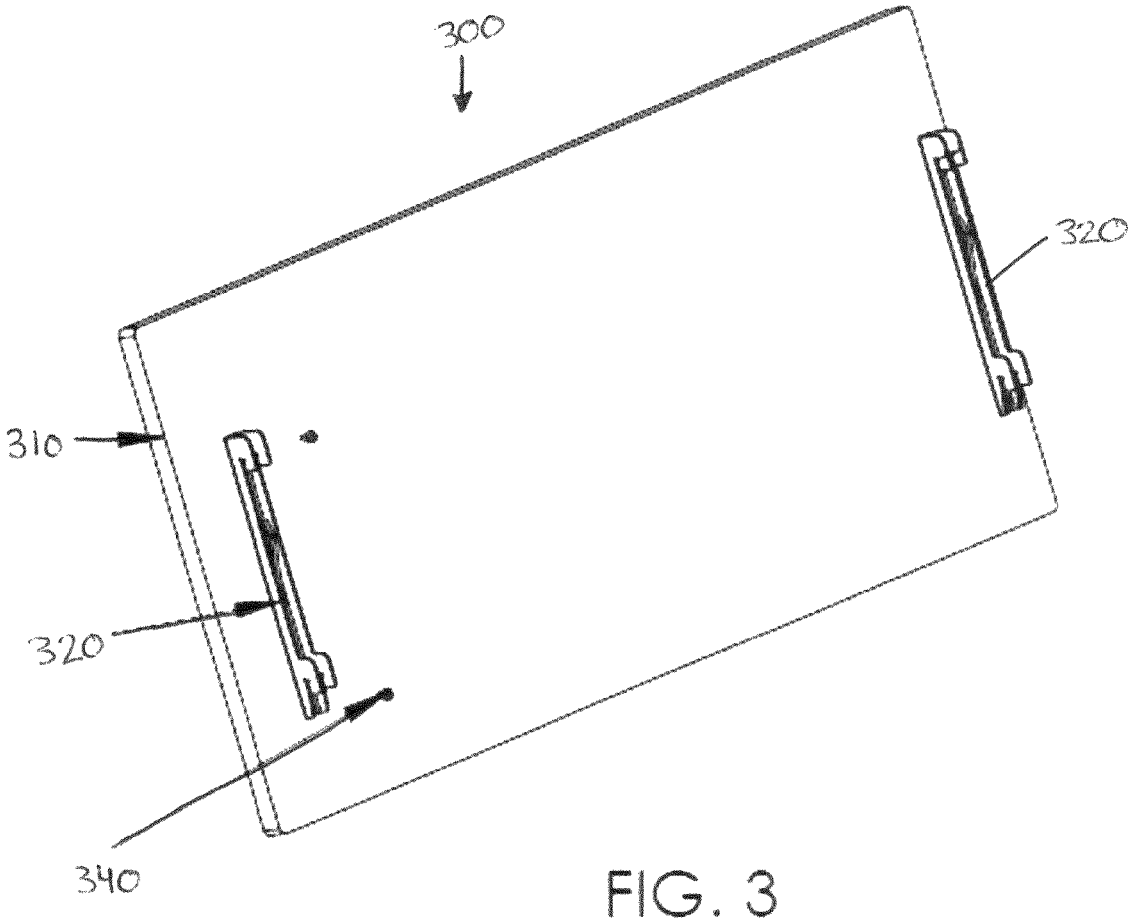
FIG. 3 is a rear, perspective view of another panel configured for releasable mounting on the frame assembly of FIG. 1.

Referring to FIGS. 2-3, panels 200, 300 include bodies 210, 310, respectively, and a pair of cleats 220, 320 mounted to the back face of the respective body 210, 220 via screws 240, 340. Embodiments of cleats suitable for use as cleats 220, 320 are detailed below.

Figure 4:
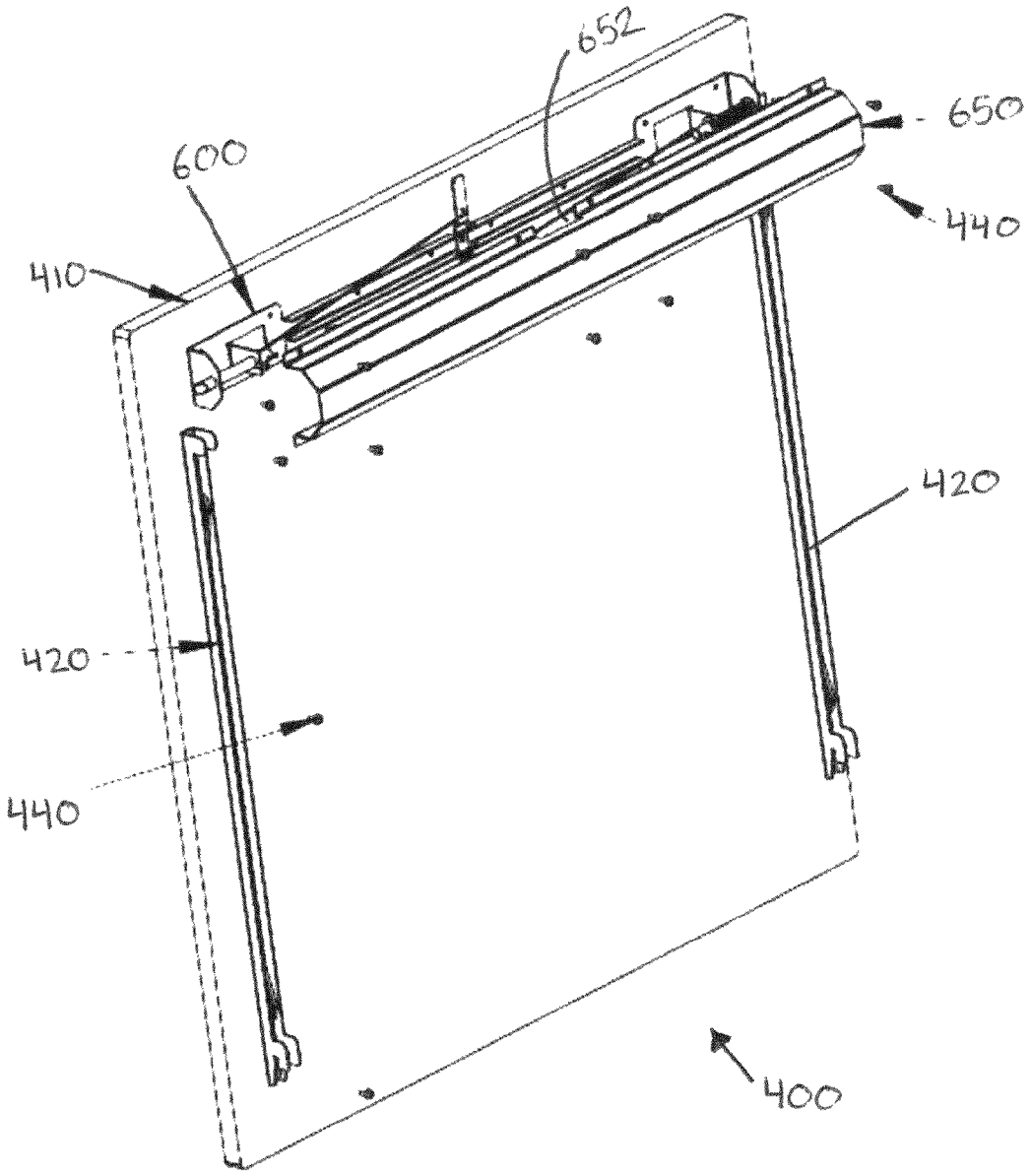
FIG. 4 is a rear, perspective, partially-exploded view of still another panel configured for releasable mounting on the frame assembly of FIG. 1.
Figure 5:
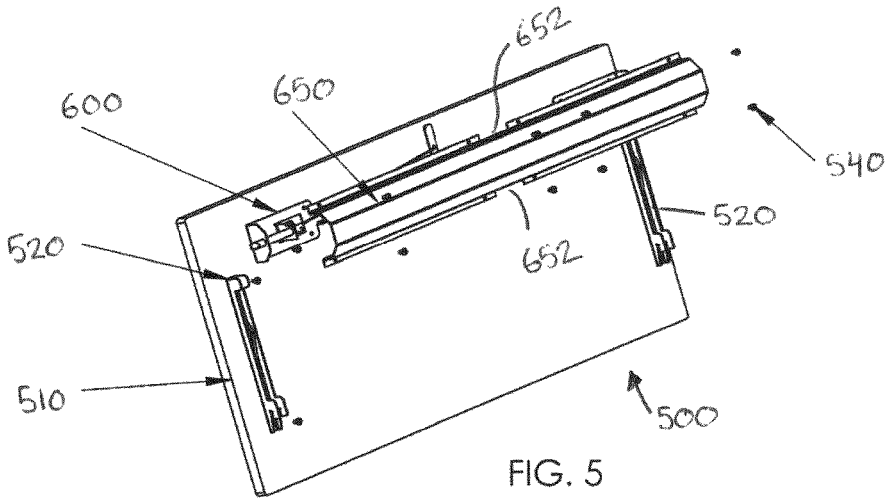
FIG. 5 is a rear, perspective, partially-exploded view of yet another panel configured for releasable mounting on the frame assembly of FIG. 1.

With reference to FIGS. 4-6, panels 400, 500 are similar to panels 200, 300 and include bodies 410, 510, respectively, and a pair of cleats 420, 520 mounted to the back face of the respective body 410, 520 via screws 440, 540. Panels 400, 500 differ from panels 200, 300 in that panels 400, 500 each further include a latch mechanism 600 engaged thereon. Latch mechanisms 600 are similar to one another and, thus, are described below in the singular with reference to one latch mechanism 600.

Latch mechanism 600 includes a base plate 610, a pair of spring posts 620, a pair of connector rods 630, a pivoting lever 640, and a cover 650. Base plate 610 may be formed from a single piece of cold rolled steel and includes an elongated body 612 and a spring finger mount 660 at each end of the elongated body 612. Elongated body 612 defines a U-shaped configuration having a pair of upright walls 614 interconnected by a floor 616. Floor 616 defines apertures 617 to enable mounting of base plate 610 to the backside of a panel, e.g., panels 400, 500, using screws or other suitable hardware. Floor 616 further pivotably supports pivoting lever 640 thereon. Upright walls 614 define opposed slots 618 adjacent the position where pivoting lever 640 is pivotably coupled to floor 616 and receive the opposing ends of pivoting lever 640 therethrough to permit pivoting of pivoting lever 640 relative to base plate 610 while defining the range of pivoting motion thereof. Pivoting lever 640 further includes a grasping extension 642 extending from one end thereof.

Each spring finger mount 660 defines apertures 661 to enable mounting of spring finger mounts 660 to the backside of a panel, e.g., panels 400, 500, using screws or other suitable hardware. Each spring finger mount 660 further includes a pair of spaced-apart support brackets 662, 664 configured to slidably support spring posts 620 therethrough.

Spring posts 620, as noted above, are slidably supported through support brackets 662, 664 of spring finger mounts 660. Spring posts 620 include biasing members 624, e.g., coil springs, disposed about the bodies 622 thereof and disposed between the support brackets 662, 664 of the corresponding spring finger mounts 660. A collar 626 is engaged about the body 622 of each spring post 620 such that as bodies 622 are slid inwardly through support brackets 662, 664, biasing members 624 are compressed. In this manner, biasing members 624 bias bodies 622 of spring posts 620 outwardly.

Connector rods 630 interconnect bodies 622 of spring posts 620 with pivoting lever 640 on opposite sides of the position where pivoting lever 640 is pivotably coupled to floor 616 of base plate 610. As such, rotation of pivoting lever 640 in a first direction, e.g., in response to pivoting of grasping extension 642 in a first direction, slides both spring posts 620 inwardly relative to base plate 610 against the bias of biasing members 624, while pivoting of pivoting lever 640 in a second, opposite direction, e.g., in response to release or return of grasping extension 642 in the second direction, slides both spring posts 620 outwardly relative to base plate 610.

Cover 650 may be formed from a single piece of cold rolled steel and is configured to surround the internal components of latch mechanism 600. Cover 650 defines a slot 652 through which grasping extension 642 of pivoting lever 640 extends to enable external manipulation of grasping extension 642. Cover 650 may be screwed or otherwise secured to base plate 610 and/or the panel, e.g., panel 400, 500.

Referring to FIGS. 1-7, in use, grasping extension 642 is moved in the first direction to retract spring posts 620 inwardly relative to base plate 610. Once this has been achieved, the panel(s) 400, 500, may be engaged between a pair of vertical struts 120, 130 using the pairs of cleats 420, 520 thereof, as detailed below. Grasping extension 642 may then be released or returned in the second direction to extend spring posts 620 outwardly relative to base plate 610 and through transverse apertures 128 of the pair of vertical struts 120, 130 to lock the panel(s) 400, 500 in engagement between the vertical struts 120, 130. However, as with panels 200, 300, latch mechanisms 600 need not be provided, depending upon a particular purpose, e.g., the load and/or use expected, depending upon the particular cleats utilized, etc.

Turning to FIGS. 8-20, cleats suitable for use with panels "P," which may be configured similar to any of panels 200-500, to releasably mount panels "P" on frame assembly 100 (see FIGS. 7 and 8) are detailed.

Figure 15:
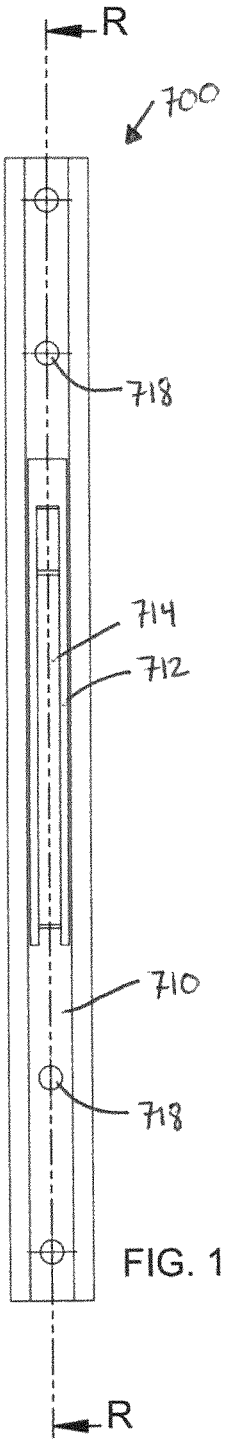
FIG. 15 is a top view of a cleat configured for use with the wall-mount system of the present disclosure.
Figure 16:
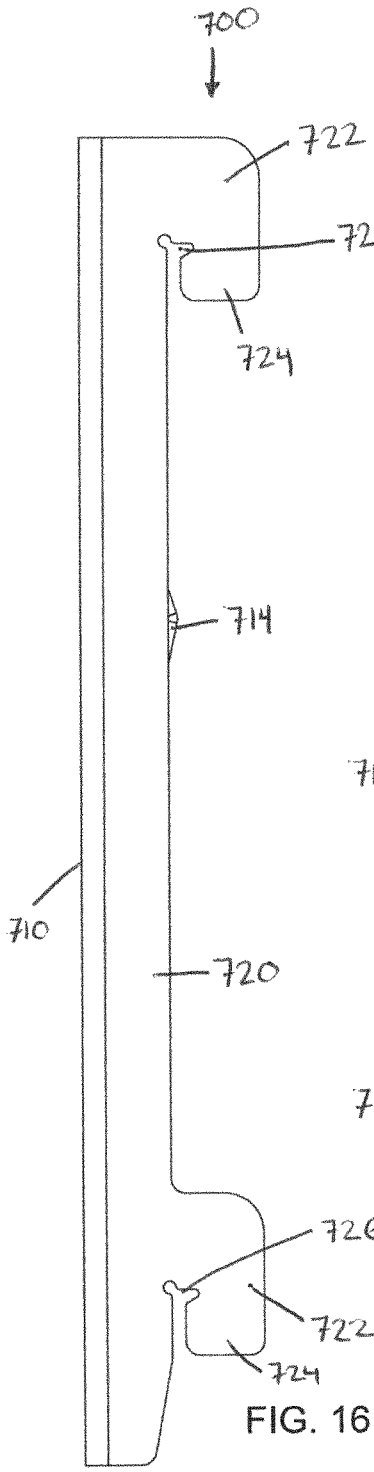
FIG. 16 is a side view of the cleat of FIG. 15.
Figure 17:
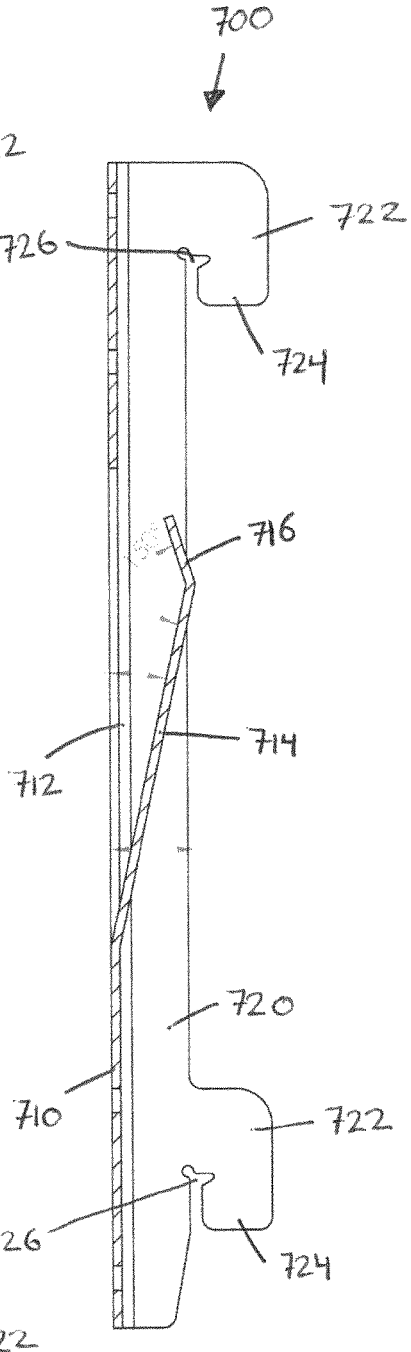
FIG. 17 is a cross-sectional view taken along section line "R-R" of FIG. 15.

Referring to FIGS. 15-17, in conjunction with FIGS. 8-14, a cleat 700 is detailed. Cleat 700 may be configured for use with a panel "P" that lacks a latch mechanism 600 (FIG. 6), e.g., panel 200, 300, or may be used with a panel "P" that includes a latch mechanism 600 (FIG. 6), e.g., panel 400, 500. Cleat 700 may be formed from a single piece of cold rolled steel and includes a base 710 having an upright 720 extending from either side thereof to define a U-shaped configuration.

Base 710 defines a partial cut-out 712 wherein sides of a piece of material are cut-out from base 710 to define a cantilever spring arm 714 that deflects inwardly from the opening defined by partial cut-out 712. Cantilever spring arm 714 defines a dog-legged free end 716 that deflects back towards partial cut-out 712. In use, as detailed below, cantilever spring arm 712 is configured to abut the mounting surface 122, 132 of the vertical strut 120, 130 cleat 700 is engaged with to bias cleat 700 away from the vertical strut 120, 130 to help maintain engagement therebetween. Base 710 of cleat 700 further defines a plurality of apertures 718 to enable mounting of cleat 700 to the backside of a panel using screws or other suitable hardware.

Uprights 720 of cleat 700 define pairs of hooks 722 extending therefrom adjacent to or at the upper and lower ends thereof, although hooks 722 may be positioned at any suitable position and/or in any suitable spacing along uprights 720. Hooks 722 define tangs 724 and notches 726. The tangs 724 of each pair of hooks 722 are configured for insertion through a receiver slot 123*a* of one of the vertical struts 120, 130 and notches 726, upon downwardly translation of cleat 700 relative to the vertical strut 120, 130, are configured to receive a portion of the vertical strut 120, 130 to engage cleat 700 therewith. The bias of cantilever spring arms 714, as noted above, helps maintain this engagement wherein tangs 724 are received within receiver slots 123*a* and notches 726 receive a portion of the vertical strut 120, 130.

Figure 18:
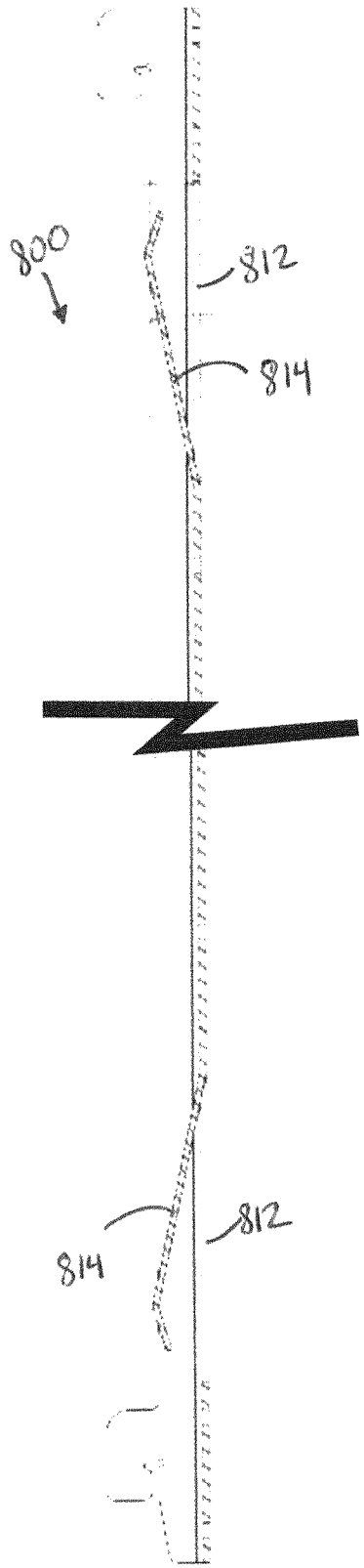
FIG. 18 is a cross-sectional view of another cleat configured for use with the wall-mount system of the present disclosure.
Figure 19:
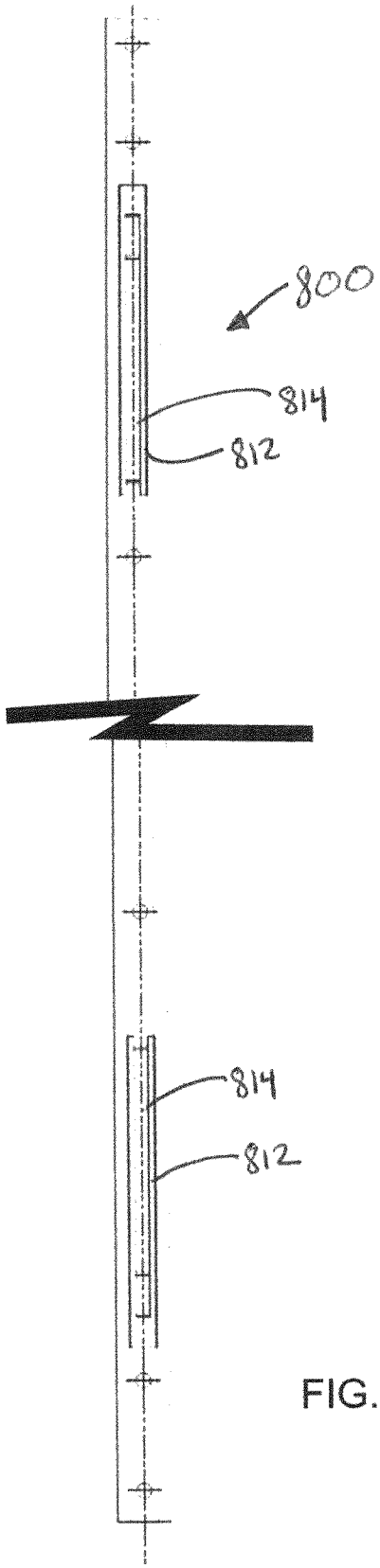
FIG. 19 is a top view of the cleat of FIG. 18.

Turning to FIGS. 18 and 19, in conjunction with FIGS. 8-14, cleat 800 is similar to cleat 700 except that cleat 800 defines a longer length and includes a pair of partial cut-outs 812 and cantilever spring arms 814 formed therefrom. Cantilever spring arms 814 are disposed towards opposite ends of cleat 800 and are oriented in opposite directions. Providing a pair of cantilever spring arms 814 in a longer cleat 800 enables biasing force to be applied closer to each of the engagement points between the cleat 800 and a vertical strut 120, 130. Additional cantilever spring arms 814 are also contemplated.

Figure 20:
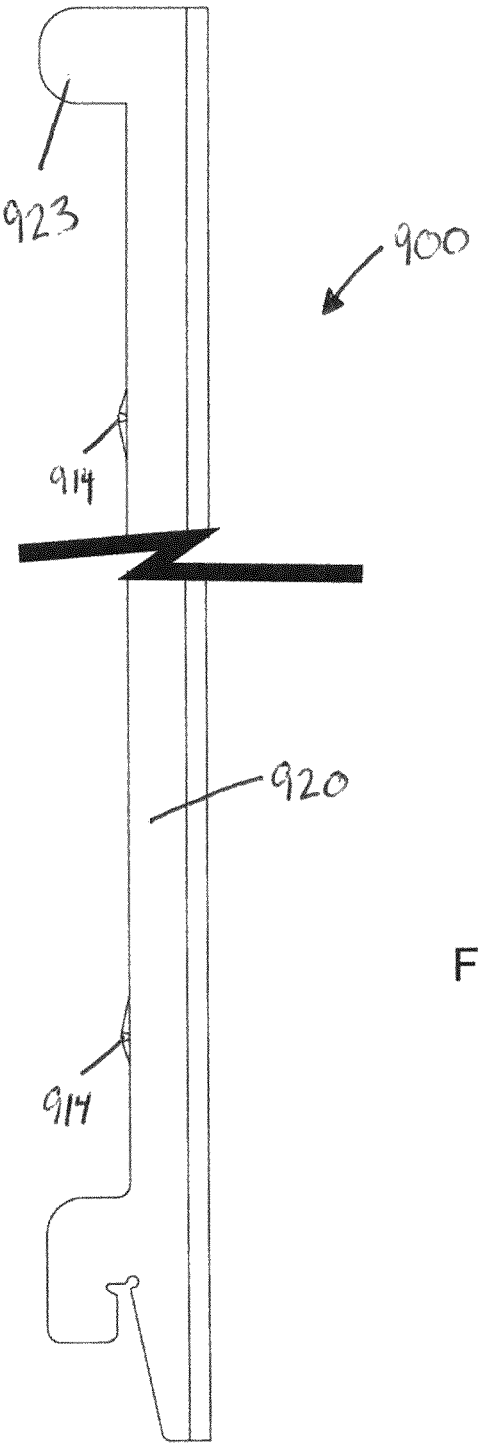
FIG. 20 is a side view of still another cleat configured for use with the wall-mount system of the present disclosure.

With reference to FIG. 20, in conjunction with FIGS. 8-14, cleat 900 is similar to cleat 700 except that, similarly as with cleat 800 (FIGS. 18-19), cleat 900 includes a pair of cantilever spring arms 914 (although only one or more than two are also contemplated) and, further, cleat 900 includes a nub 923 extending from each of the uprights 920 thereof towards the upper end thereof. Nubs 923 are configured for insertion through a receiver slot 123*a* of one of the vertical struts 120, 130; however, unlike hooks 722 (FIGS. 15-17), do not include engagement features to maintain nubs 932 in engagement within the receiver slot 123*a*. Rather, cleat 900 is configured for use with a latch mechanism 600 positioned towards the upper end of cleat 900 such that nubs 932 function to position and align, while the latch mechanism 600 is utilized to engage.

As can be appreciated in view of the forgoing, wall-mount system 10 (FIG. 7) provides modularity, secure engagement of components, and ease of assembly and dis-assembly with minimal tools required.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A wall-mount system, comprising:

a frame assembly including a plurality of horizontal ledgers configured for attachment to a wall and first and second vertical struts releasably engagable with the plurality of horizontal ledgers, each of the first and second vertical struts including a mounting surface defining a first receiver slot; and a module releasably mountable on the frame assembly, the module including first and second cleats disposed towards opposite sides of the module, the first and second cleats configured to releasably engage the first and second vertical struts, respectively, each of the first and second cleats including a base and an upright extending from each side of the base to define a U-shaped configuration, the base including a first spring finger extending therefrom between the uprights, each upright including a first hook disposed towards a first end thereof, wherein the first hooks of the first and second cleats are configured for receipt with the first receiver slots of the first and second vertical struts, respectively, to engage the module with the frame assembly, and wherein the first spring fingers of the first and second cleats are biased into contact with the mounting surfaces of the first and second vertical struts, respectively, to maintain the engagement of the module with the frame assembly.

2. The wall-mount system according to claim 1, wherein the first spring fingers are cut-out from the bases of the first and second cleats and deflected therefrom between the uprights.

3. The wall-mount system according to claim 1, wherein each of the first and second cleats is formed from a single piece of steel.

4. The wall-mount system according to claim 1, wherein the uprights of the first and second cleats include second hooks disposed towards respective second ends thereof, and wherein the second hooks are configured for receipt within second receiver slots of the first and second vertical struts, respectively.

5. The wall-mount system according to claim 4, wherein the bases of the first and second cleats include second spring fingers extending therefrom between the uprights, and wherein the second spring fingers of the first and second cleats are biased into contact with the mounting surfaces of the first and second vertical struts, respectively.

6. The wall-mount system according to claim 5, wherein the first spring fingers are disposed towards the first ends of the uprights and wherein the second spring fingers are disposed towards the second ends of the uprights.

7. The wall-mount system according to claim 1, wherein the module further includes a latch mechanism having first and second spring posts movable from a inwardly retracted position to an outwardly extended position, and wherein each of the first and second vertical struts defines a transverse aperture, the transverse apertures of the first and second vertical struts configured to receive the first and second spring posts in the outwardly extended position thereof to releasably lock the module in engagement with the frame assembly.

8. The wall-mount system according to claim 7, wherein the latch mechanism includes a lever configured for selective manipulation to transition the first and second spring posts between the inwardly retracted position and the outwardly extended position.

9. The wall-mount system according to claim 7, wherein the first and second spring posts are biased towards the inwardly retracted position.

10. The wall-mount system according to claim 7, wherein the latch mechanism extends transversely between the first and second cleats towards second ends of the uprights of the first and second cleats.

11. The wall-mount system according to claim 10, wherein the uprights of the first and second cleats include nubs towards the second ends thereof, the nubs configured for receipt within second receiver slots of the first and second vertical struts, respectively, to align the module for receipt of the first and second spring posts within the transverse apertures of the first and second vertical struts.

12. The wall-mount system according to claim 1, wherein each of the plurality of horizontal ledgers includes a pair of base flanges configured to abut a wall surface and a mounting surface raised relative to the pair of base flanges.

13. The wall-mount system according to claim 1, wherein the mounting surface of each of the plurality of horizontal ledgers defines a plurality of mounting arrangements along a length thereof.

14. The wall-mount system according to claim 1, wherein each of the plurality of horizontal ledgers is formed from a single piece of steel.

15. The wall-mount system according to claim 1, wherein the first vertical strut is a single vertical strut and wherein the second vertical strut is a double vertical strut.

16. The wall-mount system according to claim 1, wherein each of the first and second vertical struts is formed from a single piece of steel.

17. The wall-mount system according to claim 1, wherein each of the first and second vertical struts defines a C-shaped configuration including feet extending from side legs thereof, the feet configured for receipt within slots defined within the plurality of horizontal ledgers to releasably mount the first and second vertical struts on the plurality of horizontal ledgers.

18. The wall-mount system according to claim 17, wherein the first and second vertical struts and the plurality of horizontal ledgers each further include apertures configured to enable bolting of the first and second vertical struts to the plurality of horizontal ledgers.

19. The wall-mount system according to claim 1, wherein the module includes a panel having the first and second cleats mounted on a backside thereof.

* * * * *